US005553845A

United States Patent [19]

Sawa et al.

[11] Patent Number: 5,553,845

[45] Date of Patent: Sep. 10, 1996

[54] PAPER FEED ROLLER

[75] Inventors: Tsutomu Sawa, Fujisawa; Hiroyuki Takenoshita, Yokohama; Toshiki Hada, Fujisawa; Hirohide Komatsu, Machida, all of Japan

[73] Assignees: International Business Machines Corporation, Armonk, N.Y.; K R D Corporation, Kanagawa-ken, Japan

[21] Appl. No.: 275,737

[22] Filed: Jul. 19, 1994

[30] Foreign Application Priority Data

Jul. 20, 1993 [JP] Japan ..... 5-179294

[51] Int. Cl.[6] ..... B65H 29/20

[52] U.S. Cl. ..... 271/314; 271/272; 492/28; 492/49

[58] Field of Search ..... 271/109, 272, 271/314; 198/688.1; 492/28, 49, 56

[56] References Cited

U.S. PATENT DOCUMENTS

| | | | |
|---|---|---|---|
| 2,741,014 | 4/1956 | Hubbard | 492/56 |
| 5,127,325 | 7/1992 | Fadner | 492/28 |
| 5,206,992 | 5/1993 | Carlson et al. | 492/56 |

FOREIGN PATENT DOCUMENTS

| | | | |
|---|---|---|---|
| 61-23045 | 1/1986 | Japan . | |
| 61-86306 | 5/1986 | Japan | 198/699.1 |
| 0252845 | 10/1988 | Japan | 271/109 |
| 0231335 | 9/1990 | Japan | 271/109 |
| 3182443 | 8/1991 | Japan | 271/272 |

*Primary Examiner*—H. Grant Skaggs
*Attorney, Agent, or Firm*—Lowe, Price, LeBlanc & Becker

[57] ABSTRACT

A paper feed roller for delivering and feeding paper, which has a high coefficient of friction that is not affected by changes in temperature or humidity, good hardwearing properties, and is low in ink transferability. The paper feed roller includes a coating layer formed of an elastic material such as rubber which is formed on a surface of a core material molded of a foamed material such as sponge. A bonding agent having an elasticity such as denatured silicon is coated on the surface of the coating layer. Ceramic particles are embedded and fixed in the bonding agent In an alternative embodiment the bonding agent is directly coated on the surface of core material which is molded from a pliable material such as soft rubber and sponge.

26 Claims, 5 Drawing Sheets

PAPER FEED ROLLER

BACKGROUND OF THE INVENTION

1. Field of the Invention

The present invention relates to a paper delivery mechanism for deliverying sheet by sheet, sheets of paper, notes, and various other sheet-like members in copying machines, printers, facsimiles, scanners, classifiers, presses, note issuing machines, cash dispensers, etc., and to a paper feed roller which is a component of a paper feed device for feeding paper.

2. Description of the Prior Art

As materials for a delivering or feeding roller, various kinds of rubber (natural rubber and synthetic rubber) have been heretofore used. Further, for an application requiring a roller having a higher elasticity, sponges or the like obtained by foaming rubber have been used.

Characteristics required for the materials for the delivering or feeding roller are listed below:

① There should have a coefficient of friction necessary for imparting a sufficient feeding force to paper.

② The coefficient of friction is not lowered due to the change in temperature and humidity (low temperature and low humidity), change after passage of year or contaminations such as chemicals (oils and fats), ink, dust, etc.

③ Hardwearing properties are high.

④ When ink adhered to paper is transferred, the other portions of paper are not stained.

⑤ Elastic modulus can be adjusted in a wide range according to uses.

The performance of existing roller materials with respect to the requirements of the above-described five characteristics is as follows:

With respect to the ①, since the coefficient of friction of rubber is in inverse proportion to hardness, it is necessary to lower the hardness in order to obtain a high coefficent of friction. When the hardness is lowered, the performances in connection with other items ②, ③, ④, and ⑤ lowered on the other side, which is inconsistent.

Withe respect to the ②, this is a matter of a weak point in terms of properties of rubber itself. At a low temperature and a low humidity, the coefficient of friction is extremely lowered, giving rise to a trouble in feed and an inferiority in delivery. Further, since rubber is a high polymer, the characteristic thereof is unavoidably deteriorated as time passes. The average life of rubber is approximately 2 years. Thus, it is necessary to periodically replace it with new one. Further, since synthetic rubber is an organic substance, there are many rubbers which are low in chemicals-resistance. Thus, when oils and fats are adhered thereto, the coefficient of friction is lowered, and further, the deterioration in characteristic due to denature is accelerated. Further, since the coefficient of friction is ⌈Sticky⌋ in other words, ink, dust or the like tends to be adhered to a roller having a higher coefficient of friction.

With respect to the ③, rubber is low in hardness so that the rubber is shaved by paper and carbon particles (such as pencil, ink, etc.) adhered to paper as time passes to reduce its outside diameter. Replacement of rubber with new one is necessary in case where frequency of use is high.

With respect to the ④, since rubber is high in affinity with oils and fats, ink after printing is adhered to a roller in the press, and the ink is transferred to other portions of paper, resulting in an unavoidable occurrence of stain of paper.

With respect to the ⑤, the elastic modulus can be adjusted by varying the hardness of rubber, but other characterisitcs are simultaneously changed, making it necessary to keep balance.

In the case where a sponge is used, the above-described problems in connection with the ②, ③, ④ and ⑤ further becomes prominent.

As described above, materials satisfied with all the requirements described above do not exist, and in addition, the respective characteristics are mutually affected. In the past, therefore, a designer takes the most important characteristic into consideration and at the same time compromises in other aspects to determine various characteristics. Simultaneously, the designer devises a mechanism for covering the characteristics in the inferior portions for use of materials.

In explaining the conventional technique which uses a normal rubber roller, an example will be described herein in detail of a feed mechanism in which a one-side shaft is movable and upper and lower shafts are fixed, out of a double-side driving system used when paper for single slip/double slip are fed.

For the purpose of feeding a sheet of a single slip, one-side drive for imparting a drive force to only one roller out of upper and lower rollers will suffice. However, in order to stably feed a double-slip in which a plurality of sheets are placed one over another, double-side drive for imparting a drive force to the upper and lower rollers is essential. This is because of the fact that in the one-side drive system, paper feed on the side in which no feed force is imparted is delayed, and therefore, a deviation between the upper and lower sheets occurs, causing a trouble in feed.

In considering the paper feed in the feed mechanism, paper obtains a feed force from a feed roller owing to a frictional force. This force F is determined by the product of a coefficient of friction$\mu$ between paper and the roller and a pinching force P. In order to stably feed paper having a variety of thicknesses, it is necessary to weaken the pinching force P for a thin sheet of paper and gradually increase it as the thickness increases. In the prior art, this has been realized by using a mechanism described hereinbelow.

One-Side Roller Shaft Movable System

In this system, mounting of a roller on one side is made movable, and the roller is pressed by the force of a spring. The pinching force P is determined by a spring constant and a deviation amount of a spring (see FIG. 7).

This system has the drawbacks as follows: Since the distance between upper and lower roller shafts is varied, it is necessary to use, for transmission of power, several timing belts or trains of gears, thus increasing the number of parts and thus increasing the cost accordingly.

Intershaft (Upper and Lower) Fixed System

In the case where there is a restriction in terms of cost, a soft elastic substance (such as soft rubber, sponge, etc.) is used for one-side roller, and a difference between thicknesses of paper is absorbed by a collapse of the roller whereby the roller shafts on both sides are fixed to simplify the construction. The pinching force P is determined by the elastic modulus of a roller and an amount of deviation of a roller (see FIG. 8).

This system has the drawbacks as follows: In order to set a pinching force suitable for a thickness of paper, when a soft material is used to increase an amount of deviation, an amount of a collapse of a roller becomes excessively large so that a peripheral speed becomes changed, resulting in occurrences of a slip between the upper and lower rollers, an oblique feed of paper, etc., which should be most avoided.

Further, particularly in a roller using a sponge, absorbency of ink is large, and when it is used for a printer, ink not dried completely after printing is transferred to the roller, which is further transferred to paper to stain the latter.

These problems are directly related to the lowering in peformance of the machinery and the lowering in quality of print. The lower cost is charming for the machinery for aiming at a high quality. However, the intershaft fixed system has not been widely applied in terms of the restriction of the present roller material.

SUMMARY OF THE INVENTION

An object of the present invention is to provide a paper feed roller capable of being used for delivering and feeding paper, which is high in coeffeicient of friction, has sufficient hardwearing properties with the coefficient of friction not affected by the change in environment of temperature and humidity, is low in ink transferability and is small in change in passage of year of the coefficient of friction of the surface.

For achieving the aforementioned object, the present invention provides a paper feed roller in which a coating layer formed of an elastic material such as rubber is formed on an surface of a core material molded of a foamed material such as sponge, and a bonding agent having an elasticity such as denatured silicon is coated on the surface of the coating layer so that ceramic particles are fixed without clearance.

Alternatively, a bonding agent having an elasticity such as denatured silicon is coated on a surface of a core material molded of a pliable material such as soft rubber, sponge, etc. so that ceramic particles are fixed without clearance.

DETAILED DESCRIPTION OF THE INVENTION

The embodiments of the present invention will now be described with reference to the drawings.

Figure 1:
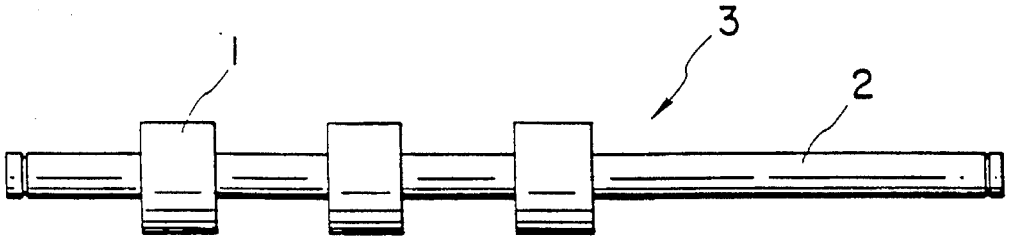
FIGS. 1(A) and 1(B) show a roller mounting member having a paper feed roller fitted therein according to the present invention, (A) being a front view, and (B) being a longitudianl sectional view.
Figure 1:
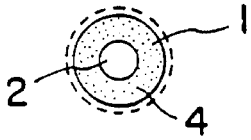

As shown in FIG. 1, a plurality of paper feed rollers 1 are fitted at predetermined intervals in an axial direction of a roller shaft 2, as shown in FIG. 1, for use as a roller mounting member 3.

Figure 2:
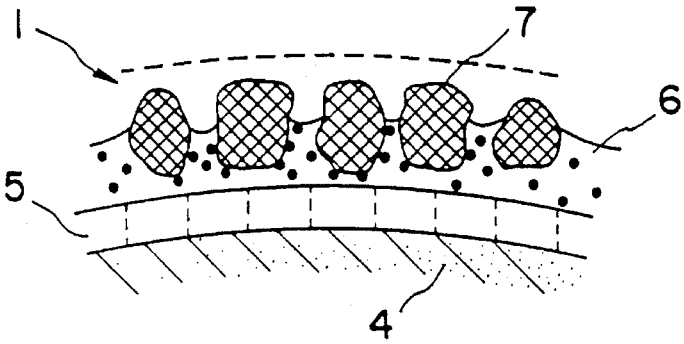
FIG. 2 is a partly enlarged longitudinal sectional view of a paper feed roller according to the present invention having a coating layer formed of an elastic material such as rubber.

The paper feed roller 1 is formed with a coating layer 5 which is obtained by bonding an elastic material such as rubber to a surface of a core material 4, which in turn is obtained by polishing a foamed material such as sponge and being formed into a cylindrical shape after which it is polished to have a predetermined dimension, by means of an adhesive or the like, as shown in FIG. 2. Then, a bonding agent 6 having a viscoelasticity such as denatured silicon is coated on the surface of the coating layer 5, and ceramic particles 7 having 3 to 300 micro m of particle diameter are fixed by the bonding agent 6.

In fixing the ceramic particles 7, the denatured silicon is first coated on the surface of the coating layer 5, and the ceramic particles 7 are adhered by their own weight or by pressing them and then set. In this step of process, the particles assume a state where about 15% of particle diameter is embedded.

Subsequently, surplus ceramic particles 7 on the surface are removed, and after this, denatured silicon is further coated on the temporarily fixed ceramic particles 7. Then, the denatured slicon present in the top portion of the particles is removed before setting. In this step of process, the particles assume a state where about 60% of particle diameter is embedded.

It is noted that denatured silicon is used as the bonding agent 6 because it has a strong contact strength with rubber constituting the coating layer 5. Alternatively, other suitable bonding agents can be used as long as they have a strong contact strength.

The ceramic particles 7 are fixed by the bonding agent 6 having the viscoelasticity. Therefore, the indvidual ceramic particles 7 can behave freely to some extent despite the fact that the relatively large-diameter ceramic particles 7 are fixed on the surface of the core material 4 without clearance. Even if the core material 4 is deformed, the ceramic particles 7 are never peeled off from the core material 4.

Figure 4:
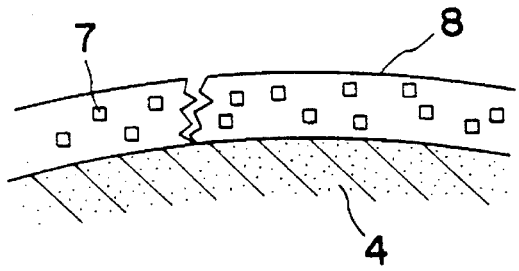
FIG. 4 is a partly enlarged longitudinal sectional view of a paper feed roller in which a ceramic layer or a ceramic dispersion layer is formed on the surface of a core material by flame spraying.

In fixing the ceramic particles 7 to the surface of the core material 4, there is a contemplated method in which a ceramic layer or a ceramic dispersion layer 8 is formed by flame spray method as disclosed in Japanese Patent Laid-Open No. 61(1986)-23045. In this case, however, since the individual ceramic particles 7 cannot behave freely, when the core material 4 is deformed, a crack occurs in the ceramic layer or the ceramic dispersion layer 8, or the ceramic particles 7 are peeled off from the core material 4, as shown in FIG. 4.

Since the coating layer 5 formed of an elastic material is formed on the surface of the core material 4, it is possible to realize the paper feed roller 1, which is high in accuracy in outside diameter and strong in the bonding force of the ceramic particles 7, by polishing the coating layer 5.

It is to be noted that the coating layer 5 may comprise a unfoamed skin layer (without being modified) formed in a portion in contact with the inner surface of a mold when a foamed material such as sponge is molded.

Sharp ends of the ceramic particles 7 are bitten into paper to thereby obtain a feed force (which is equivalent to a coefficient of friction) enough to feed paper. Further, since the hardness of the ceramic particles 7 is extremely high, the wear caused by paper is also extremely small.

Further, if the extreme ends of the ceramic particles 7 are polished by diamond to thereby remove the sharp ends thereof, it is possible to minimize a damage to paper resulting from the slip between the paper feed roller 1 and the paper, to enhance the accuracy of outside diameter and to enhance the accuracy of feed.

Figure 3:
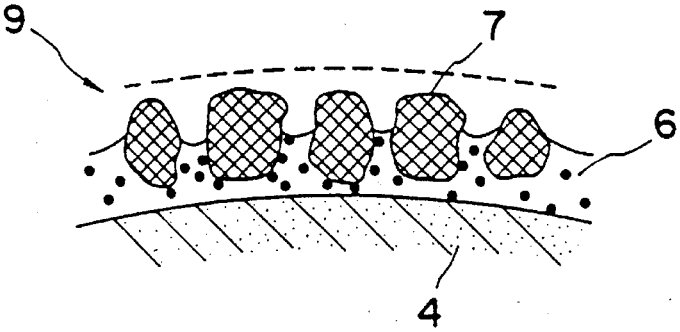
FIG. 3 is a partly enlarged longitudinal sectional view of a paper feed roller according to the present invention having no coating layer formed of an elastic material such as rubber.

Alternatively, a paper feed roller 9 may be constructed such that as shown in FIG. 3, the bonding agent 6 having the viscoelasticity such as denatured silicon is directly coated on the surface of the core material 4 obtained by polishing a pliable material such as soft rubber or sponge and forming it into a cylindrical shape, and the ceramic particles 7 having 3 to 300 micro m of particle diameter are fixed by the bonding agent 6.

However, this paper feed roller 9 is simple in construction but somewhat inferior in accuracy of outside diameter to that of the paper feed roller 1 formed with the coating layer 5. The paper feed rollers are therefore suitably selected for use in consideration of the feed accuracy, the manufacturing cost and the like.

Next, a case will be described where the paper feed roller 1 according to the present invention is applied to a paper feed device 10 of an inter-roller shaft fixed system.

Figure 5:
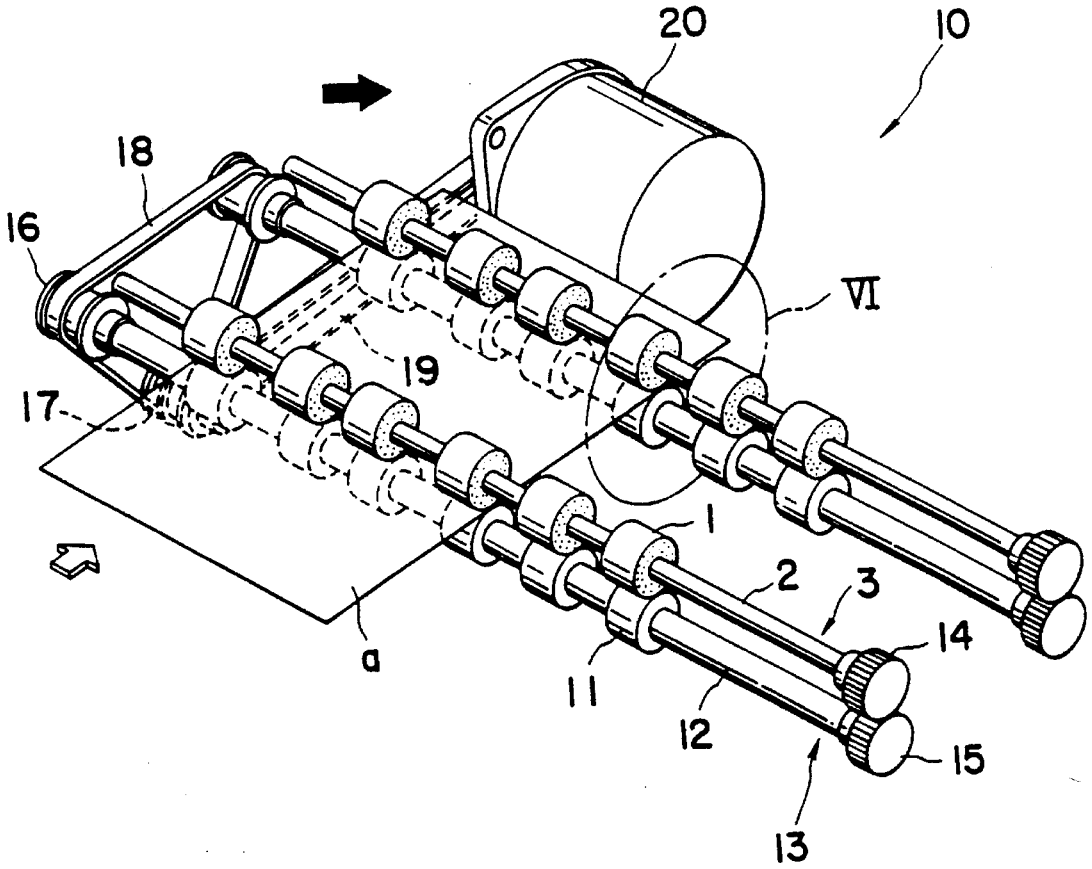
FIG. 5 is a perspective view of main parts of a paper feed device of an intershaft fixed system to which a paper feed roller of the present invention is applied.

The paper feed device 10 uses, as shown in FIG. 5, the roller mounting member 3 having the paper feed roller 1 according to the present invention fitted in the roller shaft 2, and a roller mounting member 13 having a paper feed roller 11 made of rubber fitted in a roller shaft 12.

The transmission of a drive force between the roller mounting member 3 and the roller mounting member 13 is achieved by direct engagement between a gear 14 secured to the roller shaft 2 and a gear 15 secured to the roller shaft 12.

As shown in FIG. 5, a pulley 16 is secured to the other end of the roller shaft 12, and a belt 18 is extended over between the pulley 16 and an idle pulley 17. Further, a belt 19 is extended over between the idle pulley 17 and a pulley (not shown) secured to a motor shaft to transmit the drive force of a motor 20.

Figure 6A:
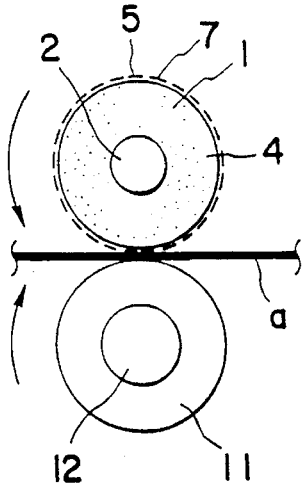
FIGS. 6(A) and 6(B) are respectively sectional views of main parts of a contact portion between upper and lower paper feed rollers shown in FIG. 5, (A) showing the state where a thin paper is fed, (B) showing the state where a thick paper is fed.

As shown in FIG. 6f since as the core material 4 for the paper feed roller 1, a foamed material such as sponge is used, in the case where as shown in (A), a thin paper a is fed, the paper feed roller 1 is not much deformed, whereas in the case where as shown in (B), a thick paper a is fed, the paper feed roller 1 is greatly deformed so that an adequate pinching force F is imparted to the paper a by the repulsion caused by the deformation.

The coating layer 5 is formed of unfoamed rubber, which is small in elastic modulus and the outer circumference thereof is hard to elongate. Thus, the force generated due to the deformation is consumed to compress the sponge which is the core material. Accordingly, the length of the outer circumference of the paper feed roller 1 remains unchanged and the paper feed accuracy is not lowered.

Now, let us think of a rubber ring only for the coating layer 5 without sponge of the core material 4 as shown in FIG. 9.

Figure 6B:
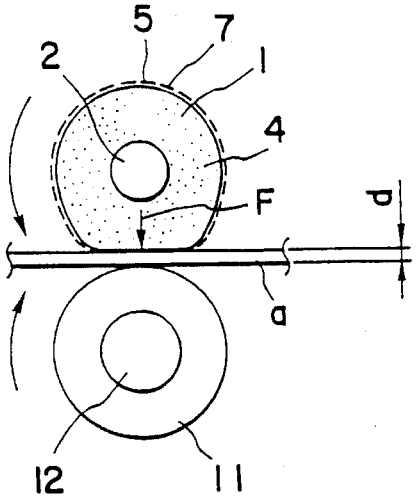
Figure 7:
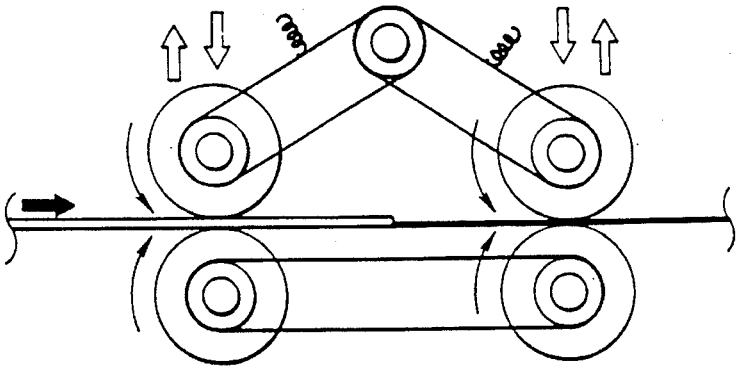
FIG. 7 is a sectional view of main parts of a paper feed device of a one-side roller shaft movable system.
Figure 8A:
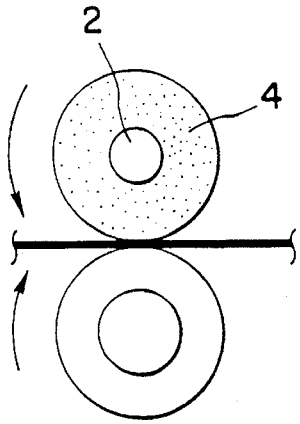
FIGS. 8(A) and 8(B) are respectively sectional views of main parts of a conventional paper feed device of an inter-roller shaft fixed system, (A) showing the state where a thin paper is fed, (B) showing the state where a thick paper is fed.
Figure 8B:
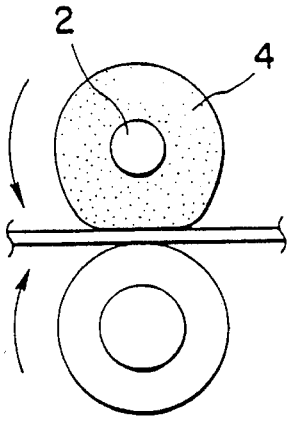
Figure 9A:
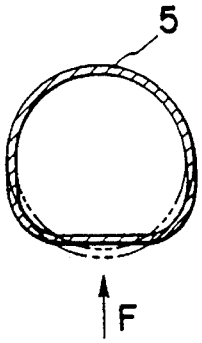
FIGS. 9(A) and 9(B) are respectively sectional views of a rubber ring of only the coating layer without sponge as a core material, (A) showing the state where an inwardly bending force is applied, (B) showing the state where an outwardly stretching force is applied so that a circumferential length is elongated.
Figure 9B:
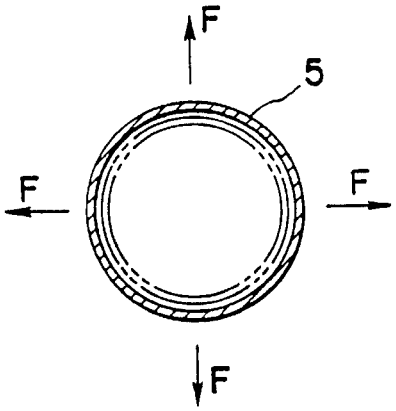

This rubber ring is hollow, and is very weak against the bending force, as shown in FIG. 9(A), since the coating layer 5 is thin, and the rubber ring becomes readily deformed. However, it is readily imaginable that an extremely great force is required to stretch the rubber ring to elongate the length of the outer circumference as shown in FIG. 9(B). Turning now back to FIG. 6(B), the deformation of the roller 1 is taken into consideration. The roller 1 is compressed by the thickness d of paper to generate the pinching force F. The roller 1 subjected to the pinching force F absorbs the force as a result that the length of the outer circumference of the coating layer 5 is not elongated and the core material 4 of the sponge is contracted. As just mentioned above, an object has properties that when the object receives a force from outside, it keeps balance in the state where a deformation energy within the object is minimum.

Since the paper feed roller 1 has the ceramic particles 7 fixed to the surface thereof without clearance, the paper feed roller 1 is provided with the characteristics of ceramic materials, without modification, which are excellent in the hardwearing properties, chemicals resistance, change-in temperature and humidity resistance, change-after passage of time resistance, heat resistance, non-ink transferability, etc.

The paper feed roller 1 further exhibits the cleaning effect such that dust or the like adhered to the surface of the paper feed roller 11 made of rubber is scraped off by the ceramic particles 7 fixed to the surface thereof without clearance.

Since ceramic is inorganic, the change in temperature and the change after passage of year are not at all involved. The ceramic is not affected by chemicals (oils and fats) due to the characteristics thereof. Further, since the ceramic repels ink, the transfer of ink is also very less.

The ceramic particles are fixed to the core material or to the surface of the coating layer formed on the surface of the core material by the bonding agent having the viscoelasticity whereby the paper feed roller as a whole is freely deformed and the ceramic particles are not peeled off from the core material.

The paper feed roller 1 according to the present invention can be applied to the feeding of paper, notes, and various sheet-like members, and further can be applied as various feed rollers such as a paper feed roller, a paper ejection roller, etc.

The above-described various properties are given in Table 1 comparing the paper feed roller 1 according to the present invention with the conventional paper feed roller.

Figure 10:
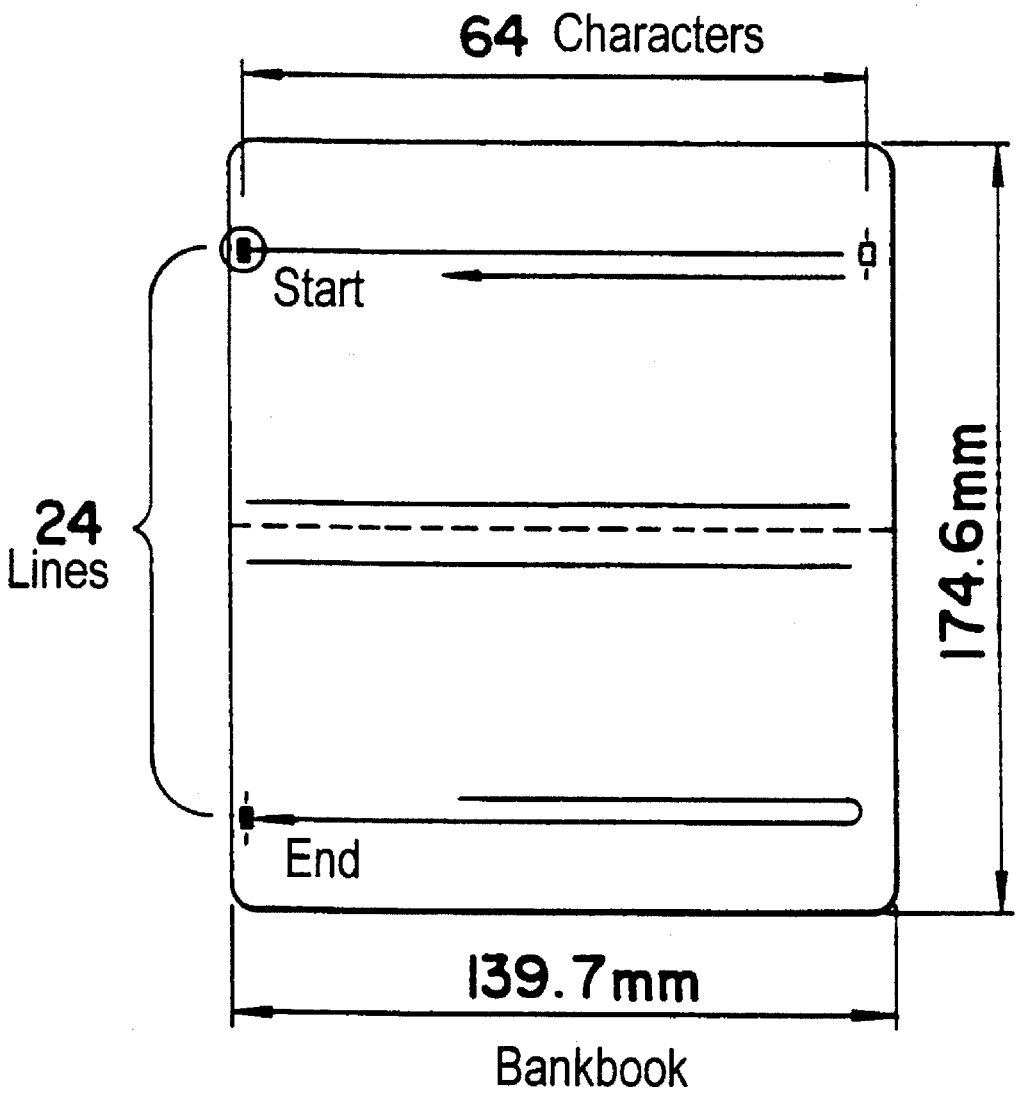
FIG. 10 is an explanatory view showing a print testing method.

The properties given in Table 1 result from the execution of the life acceleration test under the following testing condtions:

| *Testing Conditions | |
|---|---|
| Environment | Room temperature |
| Printing device | IBM9056 bankbook . form printing device |
| Ink ribbon | IBM 9056 dye ink |
| Paper | Bankbook (10 pages) |
| Printing pattern | See FIG. 10 |
| Paper feed amount | 70000 pages |

-continued

| *Testing Conditions | |
|---|---|
| Dimension of roller (OD × Width × Shaft Dia.) | ϕ16.79 × 12 × 6 (mm) |

As a core material for a roller, a pliable material such as soft rubber or sponge is used, to the surface of which are fixed ceramic particles which function to feed paper, thereby making it possble to utilize various excellent properties of the ceramic as a paper feed roller, and being capable of solving all the problems involved in conventional rubber rollers and sponge rollers.

According to the paper feed roller of the present invention, the hardwearing properties are high; no lowering of the coefficient of friction due to the change in temperature and humidity occurs; less adhesion of dust or the like occurs; the paper feed can be effected in a stable manner for a long period; the ink absorbency is low; and unnecessary ink is not transferred to paper.

Furthermore, material and hardness for the core material are suitably selected to thereby impart a flexibility to the roller, and the hardness of the roller can be freely set without affecting on the coefficient of friction of the surface and others.

By applying the paper feed roller according to the present invention, it is possible to effect the paper feed in a stable manner for a long period even in the intershaft fixed system and provide a paper feed device which is simple in mechanism and inexpensive.

TABLE 1

| PROPERTIES | CONVENTIONAL FEED ROLLER | FEED ROLLER OF PRESENT INVENTION |
|---|---|---|
| Coefficient of friction (room temperature) | 1.2 | 1.02 |
| Lowering rate of coefficient of friction | | |
| Temperature and humidity (5° C., 8%) | −21% | −6% |
| Change after passage of year | −80% | −14% |
| Chemicals resistance | Poor | Good |
| Hardwearing rate (volume rate) | 5% or more | 0% |
| Ink transfer-ability | Poor | Excellent |
| Accuracy of outside dia. | ±0.20 mm | ±0.10 mm |

We claim:

1. A paper feed roller which comprises:

a cylindrical core made of a foamed material, and having a cylindrical surface;

a layer of an elastic material coated on said cylindrical surface of said cylindrical core;

a layer of an elastic bonding agent form by coating an elastic bonding agent having viscoelasicity on said layer of elastic material; and a plurality of ceramic particles embedded and fixed in said layer of elastic bonding agent so that the individual ceramic particles can behave freely to some extent, said plurality of ceramic particles having end portions which project beyond an outer surface of said layer of elastic bonding agent so as to increase the coefficient of friction of said paper feed roller.

2. A paper feed roller according to claim 1, wherein said layer of elastic material is adhered to said cylindrical surface of said cylindrical core by means of an adhesive layer which is provided between said layer of elastic material and said cylindrical surface of said cylindrical core.

3. A paper feed roller according to claim 2, wherein said plurality of ceramic particles have a particle diameter which is greater than 3 μm and less than 300 μm.

4. A paper feed roller according to claim 3, wherein about 60% of the particle diameter of each of said plurality of ceramic particles is embedded in said layer of elastic bonding agent.

5. A paper feed roller according to claim 4, wherein the end portions of said ceramic particles which project beyond an outer surface of said layer of elastic bonding agent are polished so that the sharp extreme ends are removed.

6. A paper feed roller according to claim 3, wherein the end portions of said ceramic particles which project beyond an outer surface of said layer of elastic bonding agent are polished so that the sharp extreme ends are removed.

7. A paper feed roller according to claim 2, wherein about 60% of the particle diameter of each of said plurality of ceramic particles is embedded in said layer of elastic bonding agent.

8. A paper feed roller according to claim 7, wherein the end portions of said ceramic particles which project beyond an outer surface of said layer of elastic bonding agent are polished so that the sharp extreme ends are removed.

9. A paper feed roller according to claim 2, wherein the end portions of said ceramic particles which project beyond an outer surface of said layer of elastic bonding agent are polished so that the shard extreme ends are removed.

10. A paper feed roller according to claim 8, wherein an unfoamed skin layer formed in a portion in contact with an inner surface of a mold when a foamed material is molded is utilized as said layer of elastic material.

11. A paper feed roller according to claim 10, wherein said plurality of ceramic particles have a particle diameter which is greater than 3 μm and less than 300 μm.

12. A paper feed roller according to claim 11, wherein about 60% of the particle diameter of each of said plurality of ceramic particles is embedded in said layer of elastic bonding agent.

13. A paper feed roller according to claim 12, wherein the end portions of said ceramic particles which project beyond an outer surface of said layer of elastic bonding agent are polished.

14. A paper feed roller according to claim 11, wherein the end portions of said ceramic particles which project beyond an outer surface of said layer of elastic bonding agent are polished so that the sharp extreme ends are removed.

15. A paper feed roller according to claim 10, wherein about 60% of the particle diameter of each of said plurality of ceramic particles is embedded in said layer of elastic bonding agent.

16. A paper feed roller according to claim 15, wherein the end portions of said ceramic particles which project beyond an outer surface of said layer of elastic bonding agent are polished so that the sharp extreme ends are removed.

17. A paper feed roller according to claim 10, wherein the end portions of said ceramic particles which project beyond an outer surface of said layer of elastic bonding agent are polished so that the sharp extreme ends are removed.

18. A paper feed roller according to claim 1, wherein said plurality of ceramic particles have a particle diameter which is greater than 3 μm and less than 300 μm.

19. A paper feed roller according to claim 18, wherein about 60% of the particle diameter of each of said plurality of ceramic particles is embedded in said layer of elastic bonding agent.

20. A paper feed roller according to claim 19, wherein the end portions of said ceramic particles which project beyond an outer surface of said layer of elastic bonding agent are polished so that the sharp extreme ends are removed.

21. A paper feed roller according to claim 18, wherein the end portions of said ceramic particles which project beyond an outer surface of said layer of elastic bonding agent are polished so that the sharp extreme ends are removed.

22. A paper feed roller according to claim 1, wherein about 60% of the particle diameter of each of said plurality of ceramic particles is embedded in said layer of elastic bonding agent.

23. A paper feed roller according to claim 22, wherein the end portions of said ceramic particles which project beyond an outer surface of said layer of elastic bonding agent are polished so that the sharp extreme ends are removed.

24. A paper feed roller according to claim 1, wherein the end portions of said ceramic particles which project beyond an outer surface of said layer of elastic bonding agent are polished so that the sharp extreme ends are removed.

25. A paper feed roller according to claim 1, wherein said layer of an elastic material comprises a rubber.

26. A paper feed roller according to claim 1, wherein said elastic bonding agent comprises denatured silicon.

* * * * *